US008061639B2

(12) United States Patent
Mossotti

(10) Patent No.: US 8,061,639 B2
(45) Date of Patent: Nov. 22, 2011

(54) EJECTION DOOR FOR A MATERIAL CRUSHER

(76) Inventor: Jean-Luc Mossotti, Septemes les Vallons (FR)

( * ) Notice: Subject to any disclaimer, the term of this patent is extended or adjusted under 35 U.S.C. 154(b) by 223 days.

(21) Appl. No.: 12/298,756

(22) PCT Filed: Apr. 20, 2007

(86) PCT No.: PCT/FR2007/000666

§ 371 (c)(1),
(2), (4) Date: Mar. 2, 2009

(87) PCT Pub. No.: WO2007/125187

PCT Pub. Date: Nov. 8, 2007

(65) Prior Publication Data

US 2009/0256019 A1 Oct. 15, 2009

(30) Foreign Application Priority Data

Apr. 25, 2006 (FR) ..... 06 03652

(51) Int. Cl.
*B02C 13/286* (2006.01)

(52) U.S. Cl. ..... 241/82; 241/189.1

(58) Field of Classification Search ..... 241/82, 241/189.1, 73
See application file for complete search history.

(56) References Cited

U.S. PATENT DOCUMENTS 5,482,343 A * 1/1996 Bradac ..... 296/39.1

FOREIGN PATENT DOCUMENTS

| | | | |
|---|---|---|---|
| EP | 0376011 | A2 | 7/1990 |
| FR | 2527477 | A1 | 12/1983 |
| FR | 2634399 | A1 | 1/1990 |
| GB | 2068310 | * | 8/1981 |

* cited by examiner

*Primary Examiner* — Mark Rosenbaum
(74) *Attorney, Agent, or Firm* — Browdy and Neimark, PLLC

(57) ABSTRACT

A subject of the invention is an ejection door for the casing of a material crusher, particularly for a scrap metal crusher, characterized in that it comprises at least one aperture of defined dimensions, cut right through along the transversal axis of said door, at least one deflector positioned on the internal surface of the ejection door forming a predefined acute angle of attack with said ejection door and optionally at least two side walls, arranged on each side of the aperture, perpendicular to the ejection door and on which the deflector is supported.

10 Claims, 5 Drawing Sheets

Fig.5
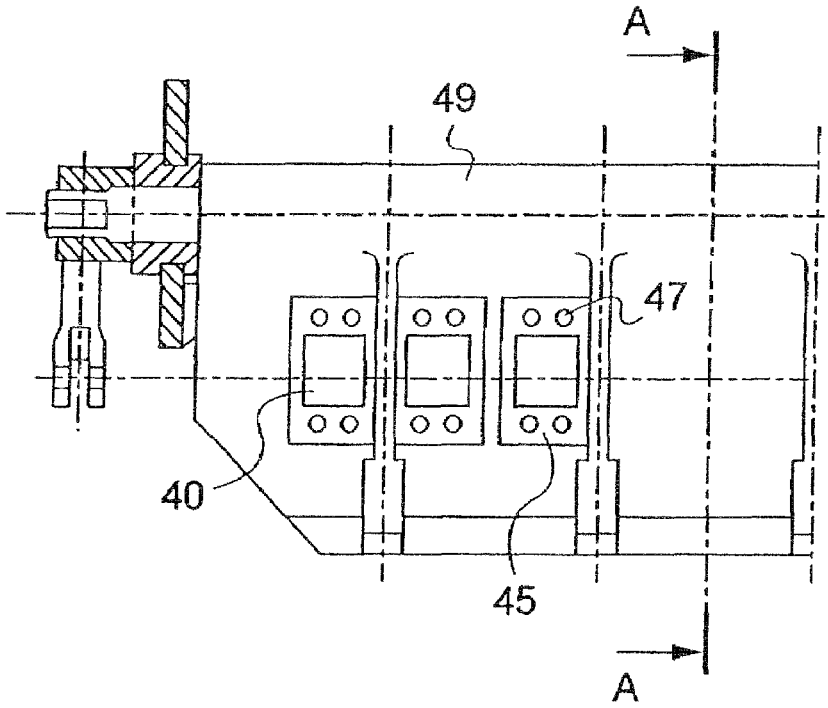
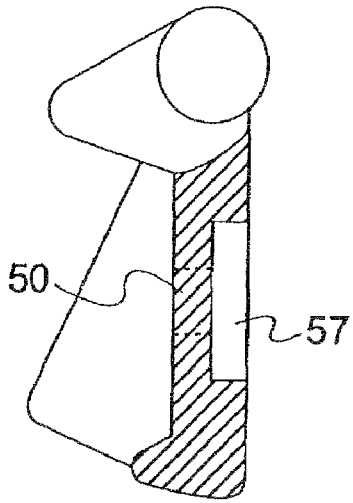
Fig.6

EJECTION DOOR FOR A MATERIAL CRUSHER

The invention relates to the field of machine-tools of the industrial crusher type and particularly, without any restriction, scrap metal crushers. The invention is in fact a development of existing crushers which allows an increase in the hourly production of crushed material, a reduction in the intensity of the load on the electric motor driving the crusher, a significant reduction in the wear of the internal walls of the crusher as well as of the crushing rotor hammers and of the anvil.

Figure 1:
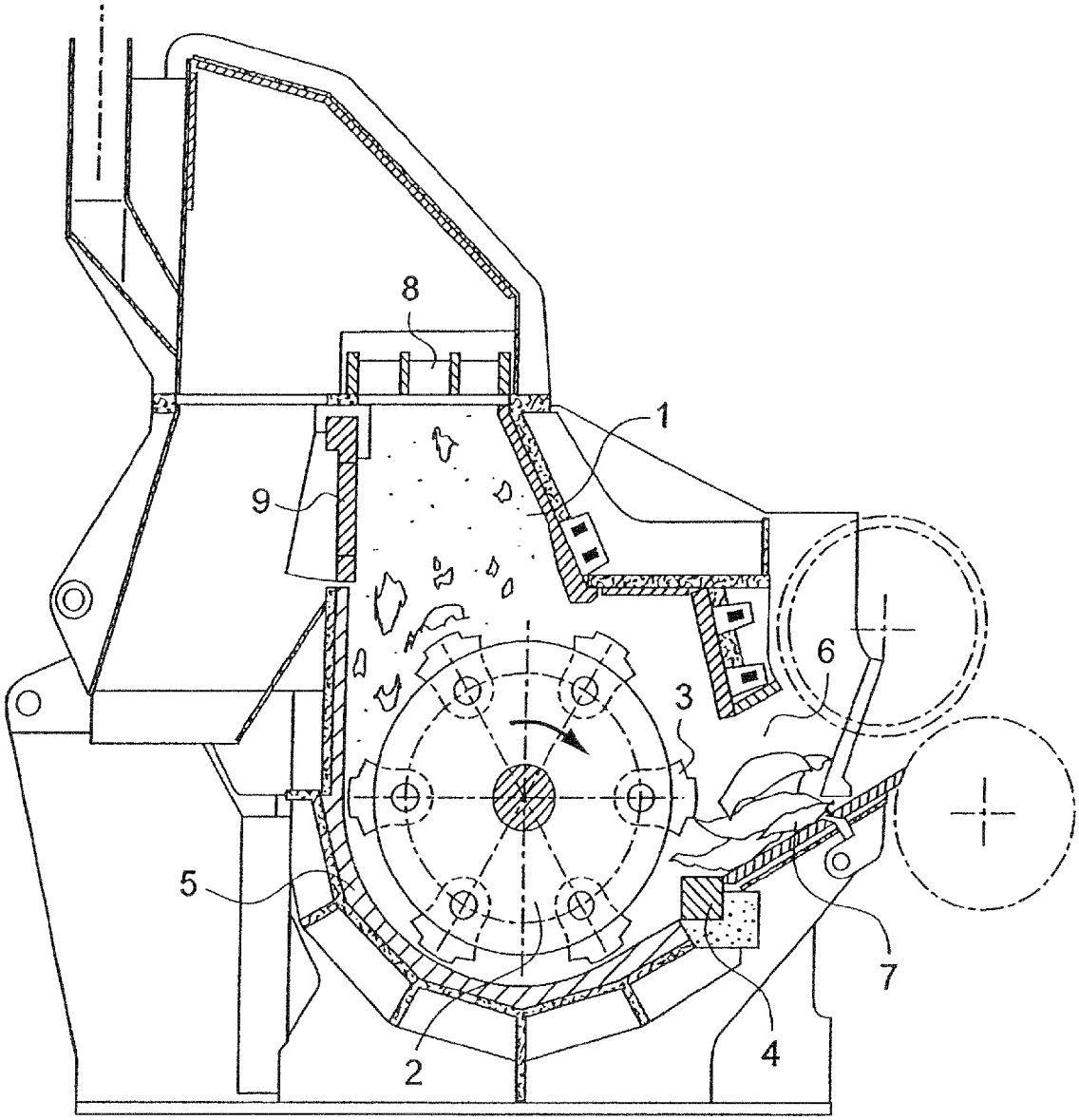

Generally, existing crushers (see FIG. 1), particularly scrap metal crushers, are constituted by an internal main casing inside which a rotor turns, driven by an electric motor. Said rotor is equipped on its periphery with hammers suitable for cooperating with the edge of an anvil integral with the casing. The casing has an internal wall covered with resistant armour plates.

The material to be crushed is introduced into the casing through an opening generally situated close to the rotor. In general the material to be crushed is conveyed up to the crusher by a conveyor belt which feeds the crusher in a continuous fashion.

The material to be crushed is moved along by the rotation of the rotor, crushed between the hammers of the rotor and an anvil. The fragments of crushed material are then dragged tangentially over the wall of the casing up to the part opposite the feed opening in order to be thrown into the upper part of the casing which comprises a grid arranged above the rotor and the mesh dimension of which is defined in order to determine the particle size of the output product: only the fragments of crushed material which have reached the desired particle size, defined by the mesh dimensions of the grid, can be ejected.

By fragments of crushed material which have reached the desired particle size is meant in the present text, fragments the particle size of which is that defined by the dimensions of the grid situated in the top part of the casing or a smaller particle size.

The fragments which cannot be ejected fall back into the casing and are taken up by the rotation of the rotor and crushed once again.

The side wall of the casing is equipped, under the level of the grid, with a hermetic ejection door, closed during the crushing time and driven by jacks.

This door performs the function of allowing the immediate ejection of pieces of uncrushable material so that they do not remain in the crushing circuit and do not result in damage to the rotor and/or hammers and/or anvil and/or walls of the casing.

In practice this ejection door is opened only on the initiative of the machine operator on noting that such pieces of uncrushable material have entered the casing.

It is therefore understood that the ejection of the fragments of material of desired particle size is done only through the grid situated in the top part of the casing and that it depends on the upward speed acquired by said fragments, a speed which must be sufficient for them to reach said grid.

This effective system which has been tried and tested does, however, have a few drawbacks.

During the crushing time, only a fraction of the fragments of material of desired particle size reaches the grid situated in the top part of the casing and is ejected through said grid. The non-ejected fragments of the desired particle size, the upward speed of which was not sufficient, then fall back into the casing and once again feed into the rotor in which new material to be crushed is engaged.

This can lead to jams at the level of the rotor and requires the motor driving the rotor to develop increased power in order to drive the extra material.

This also has the consequence of increasing wear on the walls of the casing and the hammers of the rotor due to the friction produced by these fragments which could be avoided if said fragments had been ejected.

Finally the recycling in the crushing cycle of fragments which have reached the desired particle size to be ejected, needlessly prolongs the crushing cycle and therefore slows down the production of crushed fragments which have the desired particle size corresponding to a given mass of material to be crushed introduced into the crusher beforehand.

It is understood that it could be advantageous to modify the crushers in order to be able to eject more fragments which have reached the desired particle size and more quickly.

The invention makes it possible to overcome the disadvantages of the existing systems and to considerably improve the performances of the crusher while increasing the life of the parts of the crushers (walls of the casing, hammers, rotor, anvil) with, as a consequence, a reduction in the stress on the electric motor driving the crushing rotor.

To this end the invention proposes an ejection door for the casing of a material crusher, particularly a scrap metal crusher, characterized in that it comprises at least one aperture of defined dimensions and at least one deflector positioned facing and above said aperture, on the internal surface of the ejection door forming a predefined acute angle of attack with said ejection door, said deflector being positioned parallel to the axis of rotation of the ejection door.

According to a particular embodiment said ejection door is a door for a side wall in the casing of a material crusher.

In fact, the applicant has been able to show that the hole cut in the ejection door, particularly when the door is situated in the side wall of the casing, apertures of defined dimensions and the positioning on the internal surface of this door, inside the casing, of a deflector oriented substantially towards the axis of the rotor, at the level of said apertures substantially on the upper edge of the aperture, covering said apertures and forming an acute angle of given dimension with said ejection door, thus providing an additional permanent opening in the casing, allows the fragments which have reached the desired particle size to be ejected at any time, even when they do not have the upward speed to get over the grid.

The deflector can be fixed by any appropriate means either directly onto the ejection door, or on a plate which will be fitted onto the ejection door.

According to a variant of the invention, the deflector can be fixed onto the ejection door between the axis of articulation of the door on the casing, when the latter is placed in the upper part of said door and the upper edge of the aperture. The object of the deflector is to create an obstacle in the circuit of the fragments of crushed material turning around the rotor. Said fragments then collide with the obstacle and are sent back towards the opening thus cut in the ejection door of the crusher, The apertures thus cut in the ejection door having predefined dimensions corresponding to the desired particle size, only crushed fragments of the desired particle size can then pass through said aperture and be ejected from the casing into a receptacle provided for this purpose. The fragments of greater particle size are stopped by the edges of the apertures and then fall back into the circuit and feed into the rotor again.

Side walls advantageously complete the device. These walls, which are triangular in shape, placed vertically at each end of the deflector or on each side of each aperture or at each end of the deflector and in random manner between the apertures perpendicular to the ejection door, are supported on said door. Thus they obstruct the side slot formed between the ejection door and the deflector, which ensures better guiding and/or sizing of the fragments towards the aperture.

The deflector being supported on each of the side walls, these walls moreover make it possible to strengthen the assembly by creating a support for the deflector on the ejection door.

The side walls have dimensions defined by the length of the deflector, the height of the ejection door and the angle of attack formed by the deflector and the part to which the deflector is fixed.

The side walls can be fixed by any appropriate means either directly onto the ejection door, or onto a plate onto which the deflector can also be fixed and which will be fitted to the ejection door. A preferred means for fixing the side walls is welding.

In other words, the invention proposes to provide at least one ejection hood on the ejection door of a crusher.

The ejection door in itself has dimensions identical to those of a conventional ejection door and can be made of the same material as that originally supplied by the manufacturer of the crusher in which it is installed.

It is thus understood that the invention which is the subject of the present application can be applied to any ejection door of any crusher.

Thus the equipped ejection door of the present invention can be either the original door in which the apertures are provided and to which a deflector and side walls are fitted, or an equipped ejection door of the invention manufactured on demand. In this last variant the manufactured door will replace that originally supplied by the manufacturer of the crusher in which it is installed. In this case the equipped ejection door of the present invention will have the dimensions of the original door and will be made of any material compatible with the use for which it is provided. There can be mentioned for example steel, particularly without limitation, cast manganese steel or also chromium vanadium steel.

When in a particular embodiment of the invention the ejection door comprises several apertures, the latter are made side by side along the longitudinal axis of the ejection door.

According to the invention, the apertures can take any known shape. They can be circular, square, rectangular, triangular, or elliptical in shape. Preferably the apertures are square in shape.

According to the invention, the dimensions of the apertures are defined by the particle size of the fragments of crushed material that it is desired to obtain. A person skilled in the art can adapt said dimensions to the particle size which they wish to obtain.

The deflector is advantageously mounted on the door in a detachable manner, which facilitates its replacement after wear.

According to the invention the deflector can be fitted directly onto the ejection door and fixed onto the latter in a reversible manner by any appropriate means, such as for example screwing, bolting, welding, interlocking or also mounting on a slide.

According to a variant of the invention, the deflector can be fitted onto a plate of the same material or of a material different from that of the deflector, itself comprising at least one aperture having at least the dimensions of the aperture cut in the ejection door and said plate having external dimensions greater than those of the aperture, this plate being mounted on the door in a reversible manner by any appropriate means.

A subject of the invention is therefore also a plate for an ejection door (9, 19, 29, 39, 49) for the casing of a material crusher (1) as described previously, itself comprising at least one aperture having at least the dimensions of the aperture cut in the ejection door and said plate having external dimensions greater than those of the aperture, this plate being mounted on the door in a reversible manner by any appropriate means.

A subject of the invention is therefore also the use of a plate on an ejection door (9, 19, 29, 39, 49) for the casing of a material crusher (1). In this variant the deflector can be fixed to the plate by any appropriate means. For example the deflector can be welded onto the plate.

In a preferred manner, the plate and the deflector are cast in a single piece, which has the advantage of ensuring better resistance of the assembly to the impacts produced during crushing.

When the deflector and the side walls are fitted onto a plate, this is the assembly which is fitted onto the ejection door and which is then fixed in a reversible manner to said ejection door. The fixing means can then be any reversible fixing means such as for example screwing, bolting, interlocking or also mounting on a slide. Preferably bolts are used in a number sufficient to ensure the strength of the assembly.

In a variant, the assembly plate/deflector/side walls can be fitted directly onto the internal surface of the ejection door without the latter having been subjected to any modification other than cutting the apertures.

According to a preferred embodiment, a mortise with the exact dimensions of the plate is made in the ejection door on its internal surface, around the aperture. Once positioned in the mortise, the plate/deflector/side walls assembly is fixed in a reversible manner onto the ejection door for example by screwing, bolting, interlocking or also mounting on a slide.

The deflector and/or the plate and/or the side walls can be made from any material appropriate to the use for which they are intended. For example they can be made of cast manganese steel or of antiabrasion welded mechanical steel of the HARDOX® (Swedish Steel, Sweden), CREUSABO® or equivalent types (ARCELOR, France).

Of course, as the invention can be adapted to any ejection door of any existing crusher, the latter can have variable dimensions. It is therefore understood that depending on the dimensions of the ejection door and the defined dimensions of the apertures made in said door, the number of apertures can be variable. A person skilled in the art will be able to adapt the number of apertures to the dimensions of the ejection door. Advantageously, a person skilled in the art will take care to make the maximum possible number of apertures depending on the dimensions of the ejection door in order to obtain a maximum ejection yield.

As regards the deflector, whether there is one aperture or more, there can be one only, i.e. a single part covering all of the apertures, or more than one, for example one per aperture.

It is also possible to imagine, in the case where there are several apertures, that the same deflector covers a number of apertures less than the total number of the apertures and that several deflectors cover all of the apertures.

When there is only one aperture the assembly then comprises side walls distributed on each side of the aperture. When there is more than one aperture, the assembly can comprise as many pairs of side walls, distributed in pairs, each on each side of an aperture. It is also possible to imagine that if there are n apertures the assembly comprises n+1 side walls, the same wall being able to be positioned between apertures.

The ejection door according to the invention can comprise several apertures, as many deflectors as there are apertures and side walls on each side of the apertures on which the deflectors are supported.

A subject of the invention is also a material crusher, particularly a scrap metal crusher, comprising an ejection door as described previously.

Particularly, the invention relates to a material crusher, particularly a scrap metal crusher, comprising an internal main casing, at least one rotor, hammers on said rotor, at least one anvil, a casing base which is closed and covered with resistant armour plates, a feed opening, an ejection grid arranged above the rotor and an ejection door, said ejection door being as described previously.

The invention also relates to the use of a ejection door as described previously in a material crusher, particularly a scrap metal crusher.

Figure 3:
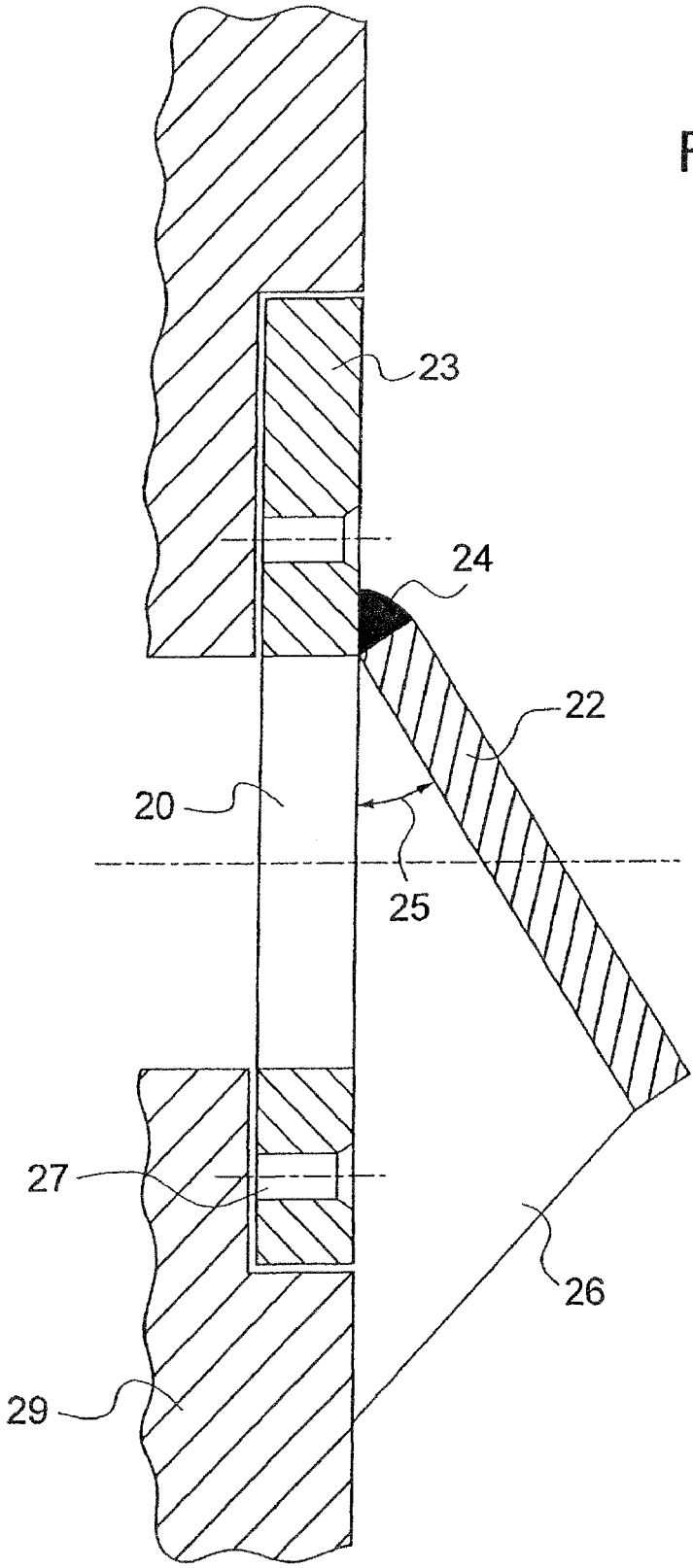

Objects, characteristics and advantages of the invention will become apparent from the description which follows, given as a non-limitative illustration, with reference to the attached drawings in which:

FIG. (1) represents a cross-section of a conventional scrap metal crusher,

FIG. (2) represents a cross-section of a scrap metal crusher according to the invention;

FIG. (3) represents a side view of a part forming a deflector mounted on an ejection door;

FIG. (4) is a front view of this part in the direction of the arrow in FIG. 3;

FIG. (5) is an internal side view of an ejection door capable of receiving as many deflectors as there are apertures;

FIG. 6 is a cross-section of this door along the axis A-A in FIG. 5.

FIG. (1) represents a cross-section of a conventional scrap metal crusher, in which the internal main casing 1, the rotor 2, the hammers 3, the anvil 4, the closed base of the casing covered with resistant armour plates 5, the feed opening 6, the material to be crushed 7, the grid 8 arranged above the rotor and the ejection door 9 are represented.

Figure 2:
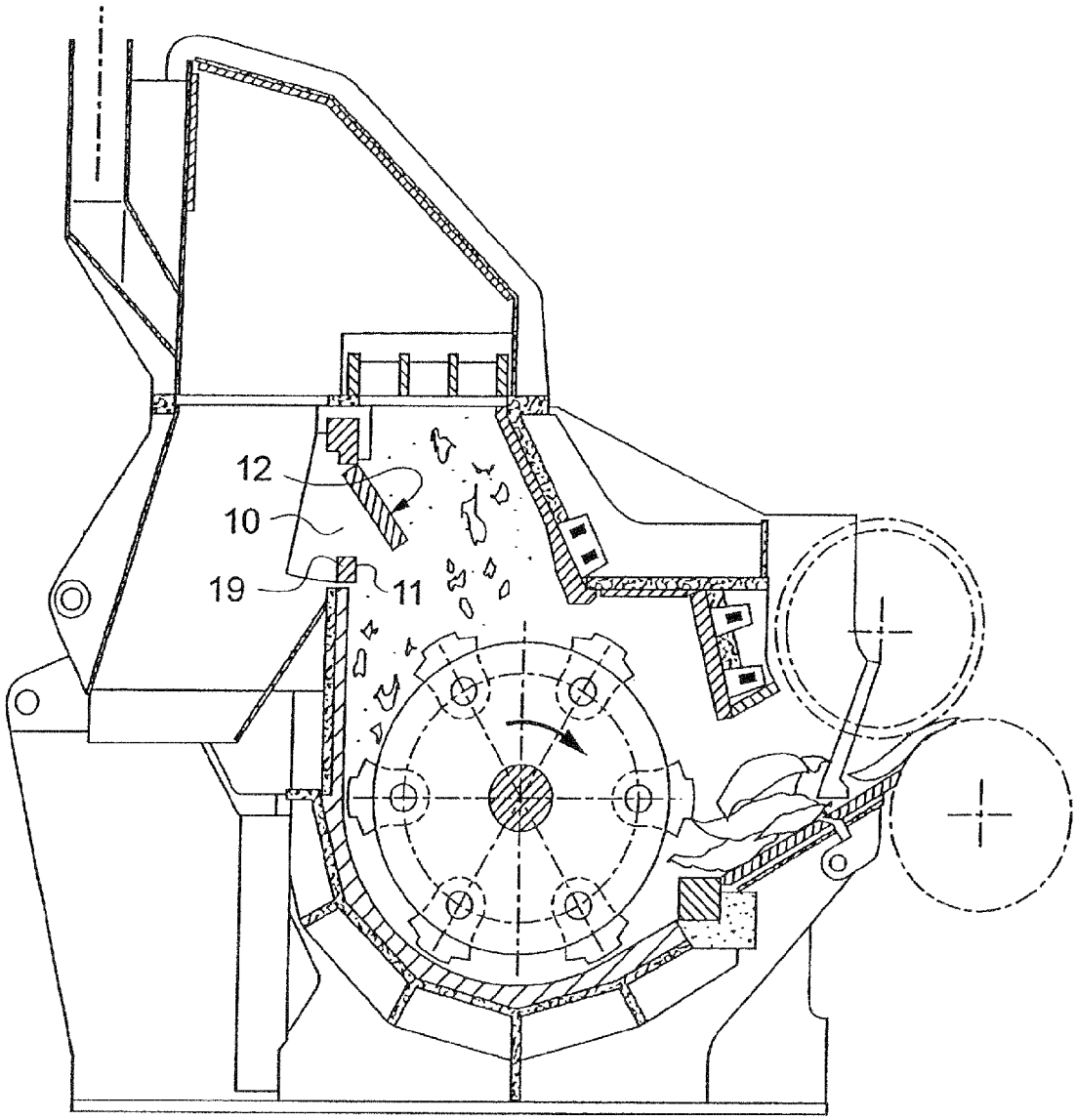

FIG. 2 represents a cross-section of a scrap metal crusher according to the invention in which the ejection door 19, the aperture 10 made in said ejection door 19, the deflector 12 and the internal surface 11 of said ejection door are represented.

FIG. 3 represents a side view of a part forming a deflector 22, fitted by mechanized welding 24 on a plate 23, according to an angle of attack 25, said plate itself comprising an aperture 20. The part is moreover equipped with side walls 26 and bolts 27. The assembly is represented mounted on an ejection door 29.

The deflector can have a length comprised between 200 and 1200 mm, preferably between 300 and 550 mm.

The angle of attack can be comprised between 5 and 80 degrees, preferably between 30 and 45 degrees.

The deflector and/or the plate and/or the side walls can have a thickness comprised between 10 and 90 mm, preferably between 35 and 45 mm.

The dimensions of the plate are at least 30 cm to 50 cm greater than the dimensions of the aperture, preferably greater than 20 cm to 30 cm.

The number of bolts can be comprised between 4 and 6, preferably 6 and said bolts can be of any diameter provided that the latter are greater than or equal to 35 mm.

Figure 4:
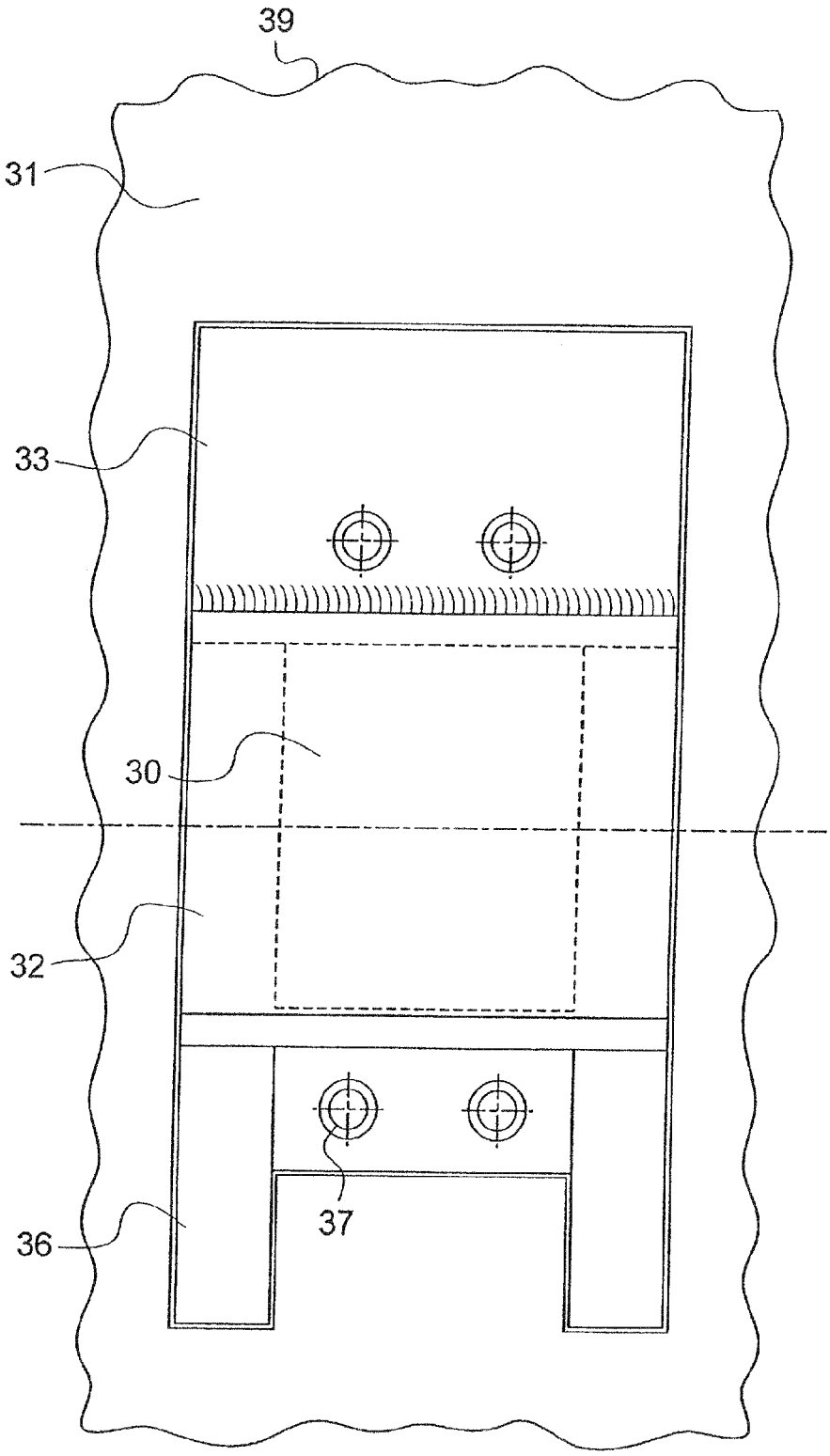

FIG. 4 is a front view of this part in the direction of the arrow in FIG. 3; in which the internal surface 31 of the ejection door 39, the square-shaped aperture 30, the bolts 37, the plate 33, the deflector 32 and the side walls 36 are represented.

If square-shaped apertures are made, the dimensions of the side of the aperture can be comprised between 30 mm and 250 mm, preferably between 50 and 200 mm. A particularly advantageous dimension is 140 mm.

When the aperture has a shape other than square, its dimensions are comprised within the same ranges.

FIG. 5 is an internal side view of an ejection door 49 capable of receiving as many deflectors as there are apertures in which the apertures 40, the mortises 45 and the location of the bolts 47 are represented.

FIG. 6 is a cross-section of the door in FIG. 5, along the axis A-A in which the aperture 50 and the mortise 55 are represented.

The invention claimed is:

1. Material crusher including a material crusher ejection door (9, 19, 29, 39, 49) for a casing of the material crusher (I), the ejection door having an internal surface and an axis of rotation, comprising at least one aperture (10, 20, 30, 40, 50) of defined dimensions cut right through along the transversal axis of said door, and at least one deflector (12, 22, 32) being positioned facing and above said aperture, on the internal surface of the ejection door (11, 31), forming a predefined acute angle of attack (25) with said ejection door, said at least one deflector being positioned parallel to the axis of rotation of the ejection door; and wherein the material crusher comprises an internal main casing, at least one rotor, hammers on said rotor, at least one anvil, a closed casing base covered with resistant armour plates, a feed opening, an ejection grid arranged above the rotor, and the ejection door.

2. Material crusher including a material crusher ejection door according to claim 1, wherein the at least one deflector (12, 22, 32) is fitted and fixed in a moveable manner directly with the ejection door.

3. Material crusher including a material crusher ejection door according to claim 1, wherein the deflector (12, 22, 32) is fitted and fixed on a plate (23, 33) itself comprising an aperture (10, 20, 30, 40, 50) having at least the dimensions of the aperture cut in the ejection door, the external dimensions of said plate being greater than those of the aperture.

4. Material crusher including a material crusher ejection door according to claim 1, further comprising side walls (26, 36), arranged perpendicular to the ejection door on each side of at least one of the apertures, and on which the deflector is supported.

5. Material crusher including a material crusher ejection door according to claim 4, wherein the plate/deflector/side walls assembly is fitted directly on the internal surface of the ejection door.

6. Material crusher including a material crusher ejection door according to claim 4, wherein the plate/deflector/side walls assembly is fitted by means of a mortise (45) on the internal surface of the ejection door and is fixed in a reversible manner to the ejection door.

7. Material crusher including a material crusher ejection door according to claim 1, further comprising several apertures, cut side by side along the longitudinal axis of the ejection door.

8. Material crusher including a material crusher ejection door according to claim 1, further comprising at least two side walls, arranged perpendicular to the ejection door and on which the deflector is supported.

9. Material crusher including a material crusher ejection door according to claim 1, further comprising several apertures, as many deflectors as there are apertures and side walls on each side of the apertures on which the deflectors are supported.

10. Material crusher including a material crusher ejection door according to claim 1, the deflector is substantially oriented towards the axis of the rotor.

* * * * *